US005786029A

United States Patent [19]

Watanabe

[11] Patent Number: 5,786,029

[45] Date of Patent: Jul. 28, 1998

[54] STENCIL PRINTING METHOD

[75] Inventor: Hideo Watanabe, Inashiki-gun, Japan

[73] Assignee: Riso Kagaku Corporation, Tokyo, Japan

[21] Appl. No.: 724,673

[22] Filed: Oct. 1, 1996

[30] Foreign Application Priority Data

Oct. 3, 1995 [JP] Japan ..... 7-278270

[51] Int. Cl.[6] ..... B05D 1/32; B05D 1/36

[52] U.S. Cl. ..... 427/282; 427/288; 427/374.4; 101/129

[58] Field of Search ..... 427/282, 288, 427/428, 374.4, 261, 258; 101/119, 129; 106/31.62, 31.63

[56] References Cited

U.S. PATENT DOCUMENTS

| | | | |
|---|---|---|---|
| 2,147,651 | 2/1939 | Jones et al. | 101/170 |
| 2,731,912 | 1/1956 | Welsh . | |
| 3,435,757 | 4/1969 | Pennington | 101/124 |
| 3,577,915 | 5/1971 | Thompson et al. | 101/129 |
| 3,656,428 | 4/1972 | Duncan | 101/129 |

FOREIGN PATENT DOCUMENTS

| | | |
|---|---|---|
| 0 729 847 A1 | 9/1996 | European Pat. Off. . |
| 2 011 617 | 9/1970 | Germany . |
| 41 27 682 A1 | 2/1992 | Germany . |
| 4233980 | 12/1990 | Japan . |
| 5271592 | 3/1992 | Japan . |
| 2 050 946 | 1/1981 | United Kingdom . |
| WO 93/03103 | 2/1993 | WIPO . |

*Primary Examiner*—Shrive Beck
*Assistant Examiner*—Fred J. Parker
*Attorney, Agent, or Firm*—Pillsbury, Madison & Sutro LLP; Cushman, Darby & Cushman IP Group

[57] ABSTRACT

A stencil printing method is provided, which includes successively transferring a plurality of printing inks of different colors through perforated stencil sheet to an object to be printed, the plurality of printing inks wherein each is capable of reversibly changing the phase from solid to liquid and having a different phase change temperature preferably within 30° to 150° C. The plurality of printing inks is transferred to the object in descending order of phase change temperature. A sharp image in color can be printed without set off or seep through, and hands are not stained with ink when the image is touched by hands.

8 Claims, 1 Drawing Sheet

STENCIL PRINTING METHOD

BACKGROUND OF THE INVENTION

1. Field of the Invention

The present invention relates to a stencil printing method, and more specifically relates to a stencil printing method which is excellent in drying of printing ink and by which an image in color can efficiently be printed with sharp resolution of overlaid ink of various colors and without set off or seep through of printing ink.

2. Background Information

Stencil printing is used in a wide range of fields because a master for printing can readily be obtained. However, it has problems such that it takes some time to dry ink after printing, ink soils hands if printed paper is touched with hands just after printing, or set off of ink occurs if pieces of paper continuously printed are laid on one another. Particularly, these phenomena are remarkable on postcards which are inferior in ink permeability.

These problems are due to the fact that drying of the conventional stencil printing ink only depends upon permeation of oil phase and evaporation of water phase, and thus drying of ink is considerably deteriorated on paper low in ink permeability.

In order to improve these defects, it has been suggested that thermosetting components be included in the oil phase and/or the water phase (refer to Japanese Patent Laid-open (Kokai) Nos. 128516/94 and 172691/94), or solid particulate be added to an emulsion ink (refer to Japanese Patent Laid-open (Kokai) No. 116525/94). However, no sufficient achievement has been obtained therefrom.

Further, the emulsion ink conventionally used varies in viscosity depending upon environmental temperature. For example, the ink becomes softer at higher temperature, and there often occurs seep through of ink or ink leakage in which ink leaks out of an end or edge of stencil sheet.

Furthermore, upon multicolor printing, if a color of printing ink first printed on printing paper is not sufficiently dried, the first ink is transferred from the printing paper to stencil sheet that has been used to print a second color of printing ink to the same printing paper, thereby causing scumming on printing paper or muddiness of overlaid colors. The only measure that has conventionally been taken to avoid such problems is to leave the paper until the first ink is completely dried. It requires a space for drying and takes a long time to finish multicolor printing.

SUMMARY AND OBJECTS OF THE INVENTION

It is an object of the present invention to solve the above mentioned problems and provide a stencil printing method which is improved in drying of ink, eliminates set off and seep through as well as ink leakage of printing ink, and can efficiently provides a sharp multicolor print.

According to the above object, the present invention provides a stencil printing method, which comprises successively transferring a plurality of printing inks of different colors through perforated stencil sheet to an object to be printed, said plurality of printing inks being each capable of reversibly changing the phase from solid to liquid and having a different phase change temperature, in which each of said plurality of printing inks is transferred to the object in descending order of phase change temperature.

The present invention employs printing ink which exhibits a reversible phase change between liquid state and solid state. Thus, when the ink is heated upon stencil printing, it can be a liquid having a given viscosity so that it can pass through perforated portions of stencil sheet. The liquid ink that has passed through the perforated portions and transferred to an object to be printed can change its phase to be in solid state so that it can set on the object in a short time.

Therefore, when a plurality of printing inks of different colors are successively passed through perforated stencil sheet and transferred to an object to be printed to effect multicolor stencil printing according to the present invention, each printing ink changes quickly from liquid state to solid state on the object. In addition, since printing ink higher in phase change temperature is printed before printing ink lower in phase change temperature according to the present invention, printing ink that has been already transferred to an object is not molten by any printing ink subsequently-printed, nor transferred to the surface of stencil sheet which is used to print the subsequent printing ink, so that a print on which colors of ink are distinctly overlaid can be obtained.

By virtue of the rapid drying of the printing ink used in the present invention, little time and space are needed for drying the ink so as to efficiently obtain multicolor prints, and hands are not stained with ink even if they touch an object that has just been printed. Similarly, no set off occurs even when objects printed out continuously are laid on one another immediately after printing, and no seep through of ink occurs because the ink does not permeate even highly permeable objects.

These advantages of the present invention are true in printing on all kinds of objects including regular printing paper and postcards low in ink-permeability as well as films and metals. Thus, the present invention can be adapted to a wide range of stencil printing on various objects.

The printing ink used in the present stencil printing method is printing ink which changes its phase from solid state to liquid state reversibly and which phase change temperature is preferably within the temperature range of 30° to 150° C., more preferably 40° to 120° C. Herein, the term "solid state" means a state in which printing ink lacks fluidity to a degree that it does not stick to any substance touching it, and the term "liquid state" means a state higher in fluidity than solid state, preferably a state in which printing ink has a viscosity to a degree that it is able to flow out of perforated portions of stencil sheet. Also, the term "phase change temperature" of printing ink means the highest temperature at which printing ink maintains the solid state. If the phase change temperature is too low, ink is fluidified at environmental temperature, soils printing machines, and tends to flow out of a side of stencil sheet or leak from an end of stencil sheet upon printing. If the phase change temperature is too high, a large-scale heating apparatus would be needed, heat energy would be unduly lost, and phase change of ink would take a long time to prolong waiting time until printing is started.

The printing ink used in the present invention can be prepared by mixing a colorant with a component which is able to reversibly transform its phase from solid state to liquid state within a temperature range of preferably 30° to 150° C. For example, it can be made by melting the reversibly transformable component and mixing it with a colorant and if necessary with a dispersant or the like.

As the above reversibly transformable component, mention may be made of, for example, waxes, aliphatic amides, aliphatic esters, and resins, more specifically, carnauba wax, microcrystalline wax, polyethylene wax, montan wax, paraffin wax, candelilla wax, shellac wax, oxide wax, ester wax, bees wax, haze wax, spermaceti, stearic acid amide, lauric acid amide, behenic acid amide, caproic acid amide, palmitic acid amide, low molecular weight polyethylene, polystyrene, α-methylstyrene polymer, vinyltoluene, indene, polyamide, polypropylene, acrylic resin, alkyd resin, polyvinyl acetate, ethylene-vinyl acetate copolymer, vinyl chloride-vinyl acetate copolymer, and the like.

As the colorant, mention may be made of, for example, organic or inorganic pigments such as furnace carbon black, lampblack, phthalocyanine blue, Victoria blue, Brilliant Carmine 6B, Permanent Red F5R, Rhodamine B Lake, Benzidine Yellow, Hansa Yellow, Naphthol Yellow, titanium oxide and calcium carbonate, and dyes such as of azo, anthraquinone, quinacridone, xanthene and acridine.

As the dispersant, mention may be made of, for example, anionic, cationic and nonionic dispersants, more specifically, sorbitan fatty acid ester, fatty acid monoglyceride, quaternary ammonium salts and the like.

The printing ink used in the present invention may be in a form of oil ink or water-in-oil (W/O) emulsion ink. Oil ink can be prepared by dissolving and mixing the above reversibly transformable component with the colorant and if necessary the dispersant. Water-in-oil (W/O) emulsion ink can be prepared by dissolving and mixing the above reversibly transformable component with the colorant and the dispersant and adding water phase components to the mixture while stirring to emulsify it. The colorant may be added to the water phase.

Upon printing, the printing ink is heated above its phase change temperature to be in liquid state. It is desired that heating is effected to a degree that viscosity of the ink becomes 10 to 1,000,000 cps, preferably 100 to 100,000 cps. If viscosity of the ink is too low upon printing, the ink tends to leak between a printing drum and an end of stencil sheet, causing ink leakage as well as seep through that is caused by ink permeating printing paper from its surface to inside. If viscosity of the ink is too high, ink does not readily pass through perforated portions of stencil sheet, and ink on printed paper becomes low and uneven in concentration.

Any process can be used to heat the printing ink upon printing. For example, in such a rotary stencil printing apparatus having an ink-permeable cylindrical printing drum which is rotated about the axis of rotation thereof with stencil sheet wound around the circumferential surface of the drum, as disclosed in Japanese Patent Laid-open (Kokai) No. 69649/93 or the like, a heating means for directly heating printing ink may be disposed inside the drum. Alternatively, a heating means which radiates infrared radiation to printing ink may be used.

Stencil sheet used in the present invention may be any one of pressure-sensitive stencil sheet, heat-sensitive stencil sheet, and soluble stencil sheet. When pressure-sensitive stencil sheet is used, perforations in a form of letters or image can be formed directly by a steel pen, a dot-matrix printer or the like. When heat-sensitive stencil sheet is used, it can be molten and perforated by allowing stencil sheet to be exposed to a flash while an original, on which an image is formed with a photothermal conversion material such as toner, is laid on the stencil sheet, or may be molten and perforated as a reproduction of letters or images by a thermal head. When soluble stencil sheet is used, it can be dissolved and perforated by transferring a solvent as a reproduction of letters or images to stencil sheet from a solvent ejecting means.

BRIEF DESCRIPTION OF THE DRAWING

Hereinafter, the present invention will be explained in more detail with reference to the accompanying drawings, in which.

Figure 1:
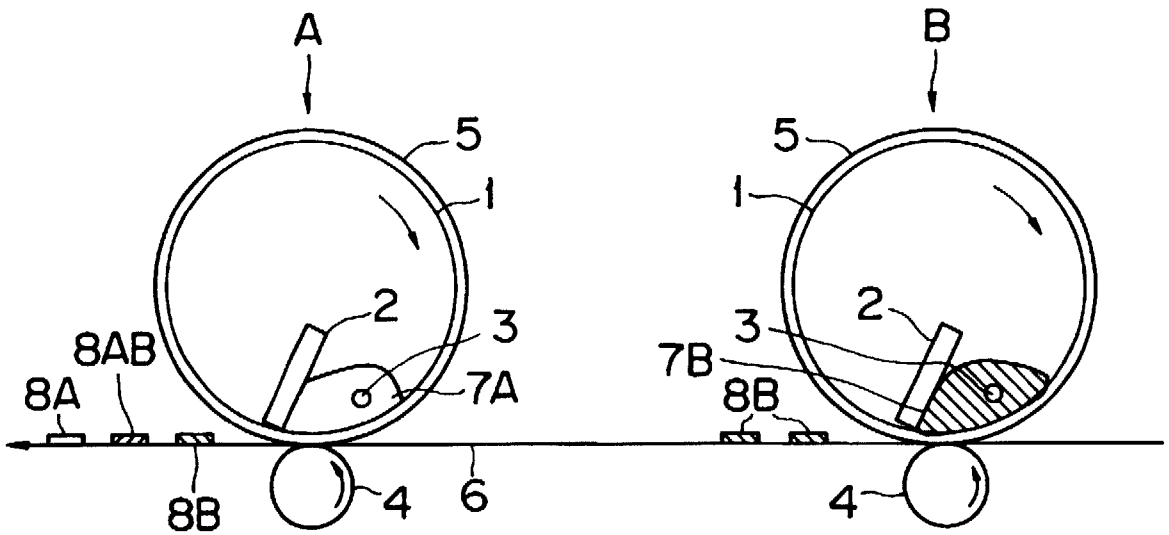
FIG. 1 is a diagrammatic sectional side view of a rotary stencil printing apparatus usable to practice the present invention.

Meanwhile, it should be construed that the present invention is not limited to the following example.

EXAMPLE

FIG. 1 diagrammatically shows a rotary stencil printing apparatus which was used to practice the printing method according to the present invention. The stencil printing apparatus has two printing drums A and B which have the same structure and are disposed in tandem so that two successive printings can be effected on one piece of printing paper 6 on the same surface thereof.

The printing drums A and B each have a circumferential surface which is constituted by an ink-permeable cylinder 1. Inside the cylinder 1, is disposed a squeeze blade 2 which slidably contacts the interior annular surface of the cylinder 1 at a lower portion thereof to feed the cylinder 1 with printing ink. Adjacent to the squeeze blade 2, is disposed a heating means 3 which heats ink supplied to the inside of the cylinder 1. Outside the cylinder 1, is disposed a press roller 4 which presses the circumferential surface of the cylinder 1 at a position opposite to the squeeze blade 2.

On the other hand, two printing inks 7A and 7B of different colors were prepared, which had the following compositions and the phase change temperatures:

| | |
|---|---|
| Printing ink 7A (yellow): | |
| Ethylene-vinyl acetate copolymer | 20 parts by weight |
| Paraffin wax | 70 parts by weight |
| Hansa Yellow | 9 parts by weight |
| Sorbitan monooleate | 1 parts by weight |
| Phase change temperature | 45° C. |
| Printing ink 7B (cyan): | |
| Ethylene-vinyl acetate copolymer | 70 parts by weight |
| Paraffin wax | 20 parts by weight |
| Phthalocyanine blue | 9 parts by weight |
| Sorbitan monooleate | 1 parts by weight |
| Phase change temperature | 65° C. |

Then, the printing drums A and B were each wound with stencil sheet in which perforations of letter images had previously been made. The printing ink 7A of yellow was fed to the inside of the printing drum A and maintained in liquid state at 50° C. with the heating means 3. The printing ink 7B was fed to the inside of the printing drum B and maintained in liquid state at 70° C. with the heating means 3. On this condition, stencil printing was effected on printing paper 6 by rotating the cylinders 1 of both printing drums A and B clockwise as seen in FIG. 1 while printing paper 6 is conveyed to the left as seen in FIG. 1 by pressing the printing paper 6 to the cylinder 1 of the printing drum B with the press roller 4.

As a result, the printing ink 7B contained in the printing drum B passed through perforations of the stencil sheet 5 and transferred in liquid state to the printing paper 6, and then instantly cooled below the phase change temperature to solidify and form sharp cyan image 8B on the printing paper 6 before reaching the printing drum A.

Then, the printing paper 6 was immediately conveyed to the printing drum A and printed in the same manner as the printing drum B. As a result, the printing ink 7A in liquid state transferred to the printing paper 6, and then instantly solidified to complete printing. In this moment, portions where printing by the printing drum A was overlaid on the image 8B printed by the printing drum B were obtained as clear image 8AB which was green, that is, a mixed color of the cyan image 8B and the yellow image 8A. Thus, it is apparent that printing in full color will be possible if further printing is effected by use of an additional printing drum containing magenta printing ink.

After printing, no adhesion of cyan printing ink 7B from the printing drum B to the surface of the stencil sheet 5 of the printing drum A was observed. Furthermore, hands were not stained with ink when images 8A, 8B and 8AB printed on printing paper 6 were rubbed with hands. Also, after 100 sheets of printing paper were printed continuously, no set off was observed between the sheets laid on each other.

According to the present invention, printing ink instantly dries just after printing, and a plurality of printing ink of different colors are transferred to an object to be printed in descending order of phase change temperature. Thus, the image in which ink of different colors are overlaid, is maintained sharp. In addition, printing ink that has been transferred to the object does not transfer to stencil sheet that is used to overlay another color of ink. Moreover, a sharp image can be printed without set off or seek through, and hands are not stained even when the image is touched by hands.

What I claim is:

1. A stencil printing method which comprises:

successively transferring a plurality of printing inks of different colors through a perforated stencil sheet to an object to be printed, said plurality of printing inks each being capable of reversibly changing its phase from solid to liquid, each of said printing inks having a different phase change temperature for the phase change from solid to liquid, in which each of said printing inks is successively transferred to the object in descending order of phase change temperature.

2. A stencil printing method according to claim 1, wherein each of said printing inks comprises a colorant and at least one other component, wherein each of said printing inks is capable of reversibly transforming its phase from solid to liquid, and said printing ink has a phase change temperature of 30° to 150° C.

3. A stencil printing method according to claim 1, wherein each of said printing inks comprises a colorant and at least one other component, wherein each of said printing inks is capable of reversibly transforming its phase from solid to liquid, each of said printing inks having a phase change temperature of 40° C. to 120° C.

4. A stencil printing method according to claim 3, wherein at least one of said printing inks is an oil ink.

5. A stencil printing method according to claim 3, wherein at least one of said printing inks is an emulsion ink.

6. A stencil printing method according to claim 2, wherein said component is a reversibly transformable component which can reversibly transform its phase from solid to liquid, and comprises a wax, an aliphatic amid, an aliphatic ester, or a resin.

7. A stencil printing method according to claim 2, wherein said colorant comprises an organic or inorganic pigment.

8. A stencil printing method according to claim 2, wherein said colorant comprises a dye.

* * * * *